US005342398A

United States Patent [19]

Sun

[11] Patent Number: 5,342,398

[45] Date of Patent: Aug. 30, 1994

[54] PACIFIER WITH INTERNAL KNURLED TEETHING MEMBER

[76] Inventor: Ping-Chang Sun, 2nd Fl.-3, No. 35, Lin Teh St., Ling Ya Dist., Kaohsiung, Taiwan

[21] Appl. No.: 104,329

[22] Filed: Aug. 9, 1993

[51] Int. Cl.[5] ..... A61J 17/00

[52] U.S. Cl. ..... 606/235; 606/234; D24/194

[58] Field of Search ..... 606/234–236; 235/11.1–11.6; D24/194–199

[56] References Cited

U.S. PATENT DOCUMENTS

| | | | |
|---|---|---|---|
| 2,612,165 | 9/1952 | Szuderski | 606/236 |
| 2,860,639 | 11/1958 | Moover | 606/234 |
| 3,115,139 | 12/1963 | Schneider | 606/235 |
| 3,455,292 | 7/1969 | Mudrinich | 606/236 |
| 3,913,402 | 10/1975 | Doyle | 606/234 |
| 4,726,376 | 2/1988 | Dahan | 606/234 |

*Primary Examiner*—Stephen C. Pellegrino
*Assistant Examiner*—Glenn K. Dawson
*Attorney, Agent, or Firm*—Merchant, Gould, Smith, Edell, Welter & Schmidt

[57] ABSTRACT

A dummy includes a hollow nipple member and a ring member including a ring with an insert rod to be inserted into the hollow nipple to secure the nipple member and the ring member together to form a dummy. The insert rod includes a plurality of knurls, each two adjacent knurls having a recess therebetween. Due to the provision of the recesses between the knurls, the gums of the baby can be advantageously massaged and the molars of the baby can be effectively ground.

1 Claim, 6 Drawing Sheets

PACIFIER WITH INTERNAL KNURLED TEETHING MEMBER

BACKGROUND OF THE INVENTION

1. Field of the Invention

The present invention relates to an improved pacifier for comforting teething babies.

2. Description of related art

A pacifier is a useful implement for comforting crying, anxious, and teething babies. One kind of pacifier, for reinforcing the structure between the teeth and the gums, has a plurality of knurls on a periphery thereof for teething babies to bite, suck, and chew, during which the gum of the baby is massaged by the knurls. However, dirt may accumulate around the protrusions, sometimes causing the babies to become ill. Another kind of pacifier has been proposed to avoid unsanitary risk, having a hollow nipple member and a ring with an insert rod to be inserted into the hollow nipple member to secure the nipple member and the ring together to form a pacifier. When in use, since the insert rod becomes flat when the baby bites, it the gums of the baby cannot be advantageously massaged as the contact therebetween is poor. Furthermore, that same poor surface contact means that the baby's molar surfaces cannot be effectively ground.

Therefore, there has been a long and unfulfilled need for an improved pacifier to mitigate and/or obviate the abovementioned problems.

SUMMARY OF THE INVENTION

The present invention provides an improved pacifier, including a hollow nipple member and a ring member. The nipple member includes a disc from which a hollow nipple projects. The ring member includes a ring with an insert rod to be inserted into the hollow nipple to secure the nipple member and the ring member together to form a pacifier. The insert rod includes a plurality of knurls, each two adjacent knurls having a recess therebetween. An air passage is formed in the insert rod adjacent to the ring for ventilating the air inside the chamber defined by the hollow nipple.

Due to the provision of the recesses between the knurls, the gums of the baby can be advantageously massaged and the molars of the baby can be effectively ground, which is particularly important to a teething baby.

Other objects, advantages, and novel features of the invention will become more apparent from the following detailed description when taken in conjunction with the accompanying drawings.

DESCRIPTION OF THE PREFERRED EMBODIMENTS

Figure 7:
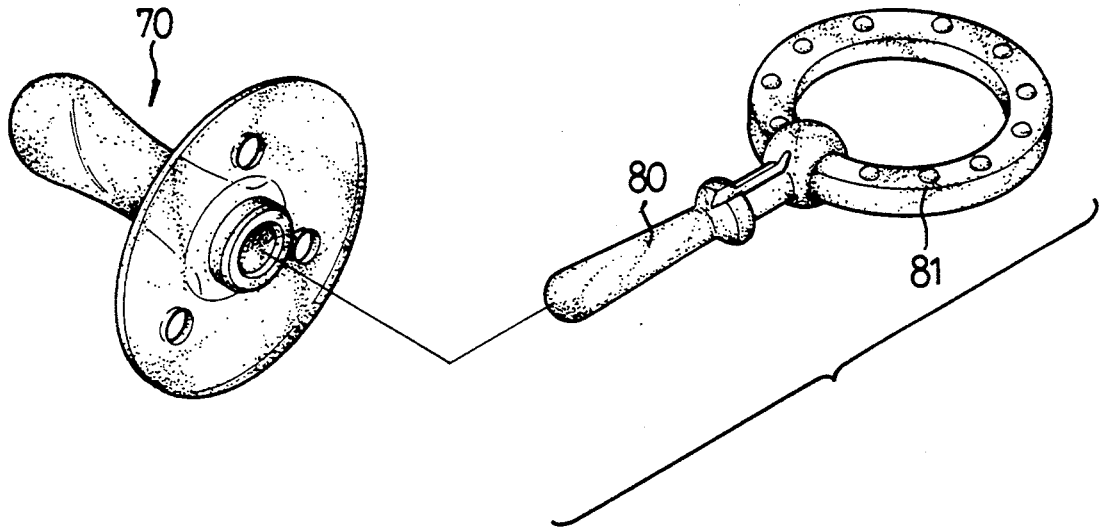
FIG. 7 PRIOR ART
FIG. 7 is an exploded view of a conventional pacifier.
Figure 8:
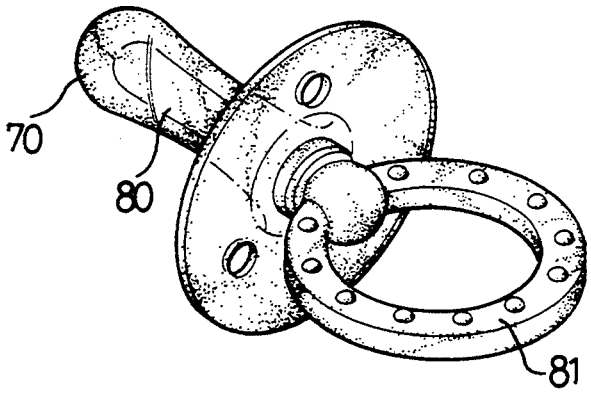
FIG. 8 is a perspective view of the conventional pacifier in FIG. 7.
Figure 9:
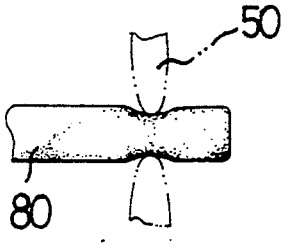
FIG. 9 PRIOR ART
FIG. 9 is a view illustrating the contact between the gums of a baby and the conventional pacifier in FIG. 7.
Figure 10:
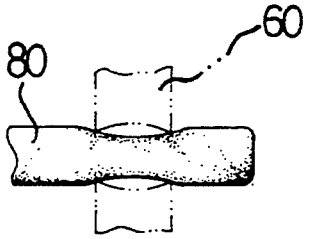
FIG. 10 PRIOR ART
FIG. 10 is a schematic view illustrating the contact between the molars of a baby and the rod of the conventional pacifier in FIG. 7.

For a better understanding of the present invention, reference is made to FIGS. 7 and 8 in which a conventional pacifier design is shown. The pacifier includes a hollow nipple member 70 and a ring 81 with an insert rod 80 to be inserted into the hollow nipple member 70 to secure the nipple member 70 and the ring 81 together to form a pacifier. When in use, as shown in FIG. 9, since the insert rod 80 becomes flat when the baby bites, it the gums 50 of the baby cannot be advantageously massaged as the contact therebetween is poor. Furthermore that same poor contact means that the baby's molar surfaces 60 cannot be effectively ground, as shown in FIG. 10.

Figure 1:
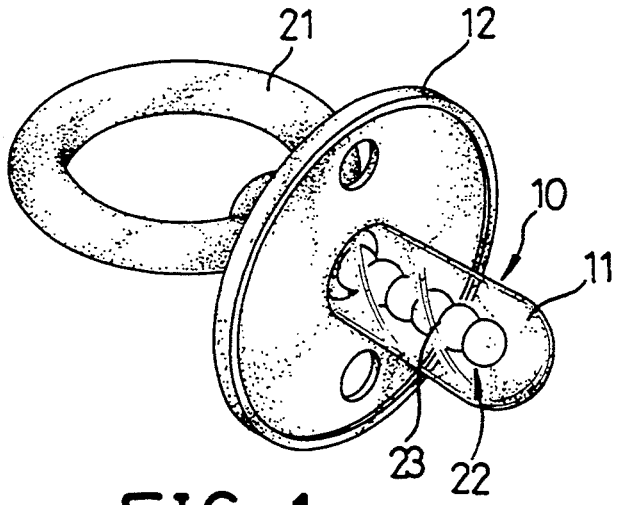
FIG. 1 is a perspective view of a pacifier in accordance with the present invention.
Figure 2:
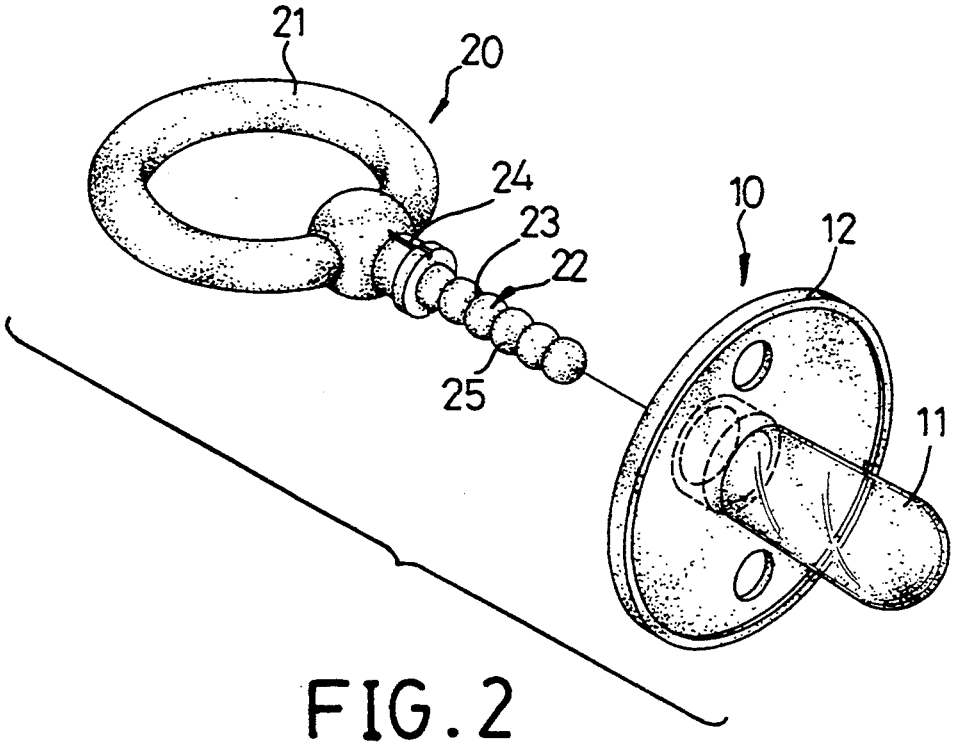
FIG. 2 is an exploded view of the pacifier.
Figure 3:
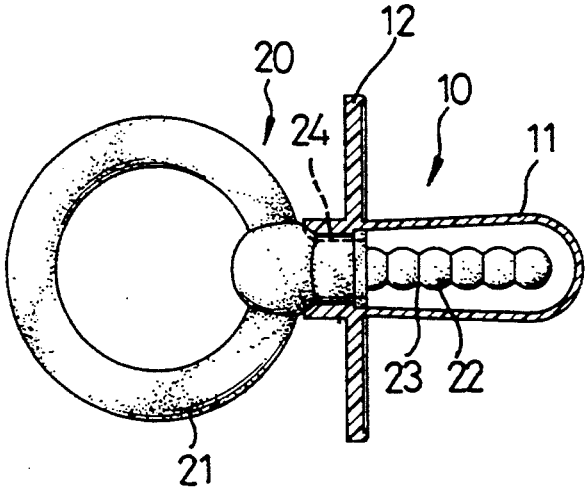
FIG. 3 is a side view, partly sectioned, of the pacifier.

To this purpose, the present invention provides an improved pacifier as shown in FIGS. 1 through 3, including a hollow nipple member 10 and a ring member 20. The nipple member 10 includes a disc 12 from which a hollow nipple 11 projects. The ring member 20 includes a ring 21 with an insert rod 22 to be inserted into the hollow nipple 11 to secure the nipple member 10 and the ring member 20 together to form a pacifier. The insert rod 22 includes a plurality of knurls 25, each two adjacent knurls 25 having a recess 23 therebetween. An air passage 24 is formed in the insert rod 22 adjacent to the ring 21 for ventilating the air inside the chamber defined by the hollow nipple 11.

Figure 4:
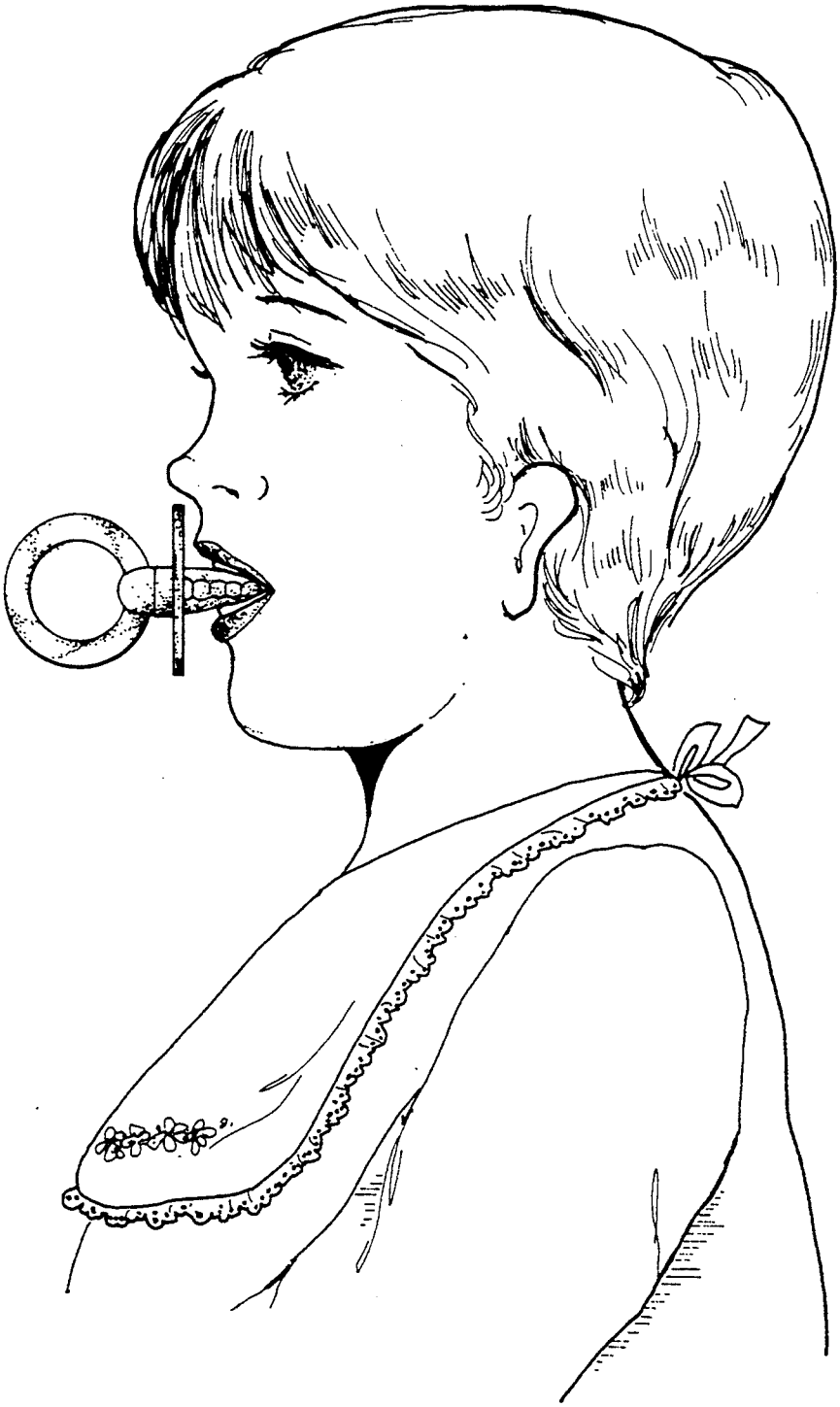
FIG. 4 is a schematic view illustrating the use of the pacifier.
Figure 5:
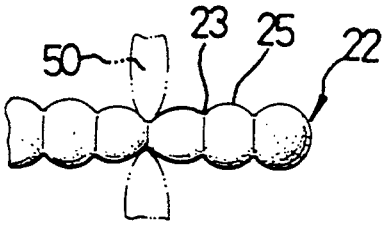
FIG. 5 is a partial view illustrating massage effect on the gum of a baby provided by the present pacifier.
Figure 6:
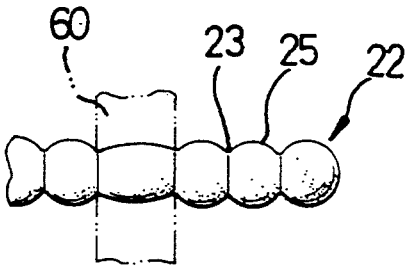
FIG. 6 is a partial view illustrating the contact between the molar of a baby and the insert rod of the present pacifier.

FIGS. 4 through 6 illustrate the use of the pacifier, in FIG. 5, due to the provision of the recesses 23 between the knurls 22, it can be seen that the gums of the baby can be advantageously massaged when the baby bites the nipple 11 and of course the insert rod 22. In FIG. 6, also due to the provision of the recesses 23 between the knurls 22, the molars 60 of the baby can be effectively ground, which is particularly important to a teething baby.

Although the invention has been explained in relation to its preferred embodiment, it is to be understood that many other possible modifications and variations can be made without departing from the spirit and scope of the invention as hereinafter claimed.

I claim:

1. A pacifier comprising a hollow nipple member having an inner wall and a ring member including a ring with an insert rod; said hollow nipple member and said ring member being secured together such that said insert rod projects into said hollow nipple member, said insert rod having a gum massaging surface spaced from said inner wall including a plurality of knurls, each two adjacent said knurls having a recess therebetween.

* * * * *